United States Patent [19]

Hegdahl

[11] Patent Number: 4,953,901

[45] Date of Patent: Sep. 4, 1990

[54] HIGH SECURITY KEEPER AND REINFORCEMENT BAR FOR ENTRY DOOR

[76] Inventor: Randy A. Hegdahl, 7521 Jersey Ave. North #205, Brooklyn Park, Minn. 55428

[21] Appl. No.: 473,905

[22] Filed: Feb. 2, 1990

[51] Int. Cl.[5] ..... E05C 1/16; E05C 21/02

[52] U.S. Cl. ..... 292/340; 292/346

[58] Field of Search ..... 292/346, 340, 1, 175, 292/163, 169 R

[56] References Cited

U.S. PATENT DOCUMENTS

| | | | |
|---|---|---|---|
| 1,245,049 | 10/1917 | Silverstein | 292/340 X |
| 1,325,919 | 12/1919 | Voight | 292/340 X |
| 1,428,367 | 9/1922 | Forlander | 292/346 X |
| 1,844,459 | 2/1932 | Brandon | 292/346 |
| 2,144,075 | 1/1939 | Mora | 292/346 |
| 2,370,781 | 3/1945 | Cullum | 292/346 |
| 2,533,396 | 12/1950 | Payne | 292/340 |
| 3,888,530 | 6/1975 | Fabrici | 292/346 X |
| 3,967,845 | 7/1976 | Governale | 292/340 |
| 4,189,175 | 2/1980 | Poxton | 292/346 X |
| 4,547,009 | 10/1985 | Allen | 292/346 |
| 4,635,399 | 1/1987 | Gehrke et al. | 292/346 X |
| 4,717,185 | 1/1988 | Hartley | 292/340 |
| 4,770,452 | 9/1988 | Petree, Jr. | 292/340 |
| 4,802,701 | 2/1989 | Mazie | 292/340 |
| 4,869,087 | 9/1989 | Day | 70/452 X |

*Primary Examiner*—Richard E. Moore
*Attorney, Agent, or Firm*—Robert C. Baker

[57] ABSTRACT

A strike plate for an entry door structure. The strike plate consists of a unitary metal member having a face portion which merges into a curved lip portion which merges into a lateral flange oriented perpendicularly to the face portion. The face portion has an upper and lower edge defining the vertical dimension thereof and a recess for receiving an outwardly-biased latch member of a door, and has mounting holes for screw members to fix the face portion on the face surface of a jamb of a frame for an entry door structure. The lateral flange has upper and lower edges defining the vertical dimension thereof. The vertical dimension of the flange is greater than the vertical dimension of the face portion. The lateral flange has mounting holes extending therethrough exclusively at locations more spaced apart vertically than the mounting holes through the face portion. Screw mounting of said strike plate on a jamb of an entry door structure effectively causes the screws mounting the face portion to be at locations between the screws mounting the flange on the jamb. An additional entry door enhancement for obstructing unauthorized entry is a special rigidifying strip strip for the entry door itself.

4 Claims, 2 Drawing Sheets

HIGH SECURITY KEEPER AND REINFORCEMENT BAR FOR ENTRY DOOR

BACKGROUND OF THE INVENTION

This invention relates to entry door enhancements, and more particularly to an improvement in the strike plate for enhancing strength of latching of the door and thwarting unauthorized forced opening of the door from the exterior side. In combination with the new strike plate, the invention provides door reinforcement functioning in combination with the improved strike plate for further thwarting unauthorized forced opening of the door from the exterior side.

Many proposals have been advanced for the improvement of entry doors as barriers to unauthorized entry. Insofar as is known, however, the approaches of the past have concentrated on such severe modification of conventional entry door structures as to make them impractical for use except in new construction. The teaching of this invention is easily implemented in existing structures and has the additional benefit of not interfering with the general attractiveness of the conventional appearance for entry door structures.

The invention is not designed to thwart entry by those who would resort to bulldozing techniques. Those who attempt unauthorized entry for burglary or any other purpose generally shun from bulldozing techniques in favor of techniques which leave little apparent evidence of unauthorized entry, such as the technique of using a screwdriver or similar implement as a wedge at the spring biased latch member of the entry door while simultaneously applying pressure on the entry door. The teachings of this invention are particularly effective to thwart such manner of unauthorized entry, and it is believed that such manner of unauthorized entry has an unfortunate degree of popularity.

SUMMARY OF THE INVENTION

The entry door enhancements of this invention are for entry door structures having an exterior side and an interior side and comprising a frame and door. The door has an exterior side and an opposing interior side, a free vertical edge, and a latch member biased to project outwardly from the free vertical edge.

The frame of the entry door structure has a vertical jamb which has a vertical interior edge surface and a vertical face surface. The vertical face surface is substantially parallel and proximate to the free vertical edge of the door when the door is closed. A vertical stop strip is fixed to the jamb toward the exterior side of the door structure; and this is for abutment stopping of swinging closure motion of the door in the frame. A vertical trim strip is conventional and extends along the vertical interior edge surface of the jamb of the door structure. A strike plate on the jamb is at a location to be struck by the latch member of the door on swinging closure motion of the door in the frame.

The strike plate of this invention consists of a unitary metal member having a face portion which merges into a curved lip portion which merges into a lateral flange oriented perpendicularly to the face portion. The face portion has upper and lower edges defining the vertical dimension of the face portion, and has a recess for receiving the latch member of the door. Further, the face portion has spaced mounting holes through which mounting screws extend into the jamb of the door structure to fix the face portion on the face surface of the jamb. Preferably, the mounting holes of the face of the new strike plate are located toward the edge of the face portion nearest the exterior side of the entry door structure.

A significant feature of the new strike plate is its lateral flange. This flange has upper and lower edges which define the vertical dimension of it. The vertical dimension of the flange is greater than the vertical dimension of the face portion of the strike plate, and the flange has mounting holes extending through it exclusively at locations higher and lower (i.e., more spaced apart) than the mounting holes through the face portion of the strike plate.

The lateral flange of the strike plate is securely mounted to the interior edge surface of the jamb of the door structure and this lateral flange is beneath the trim strip of the door structure. Screw members extend through the mounting holes of the lateral flange into the jamb of the door structure.

Because of the arrangement of the mounting holes of the face portion and the lateral flange of the strike plate, all screws mounting the face portion on the jamb extend into the jamb at locations between the jamb penetration of screws for holding the flange on the jamb. This enhances the resistance of the strike plate to forces for pushing it out of the jamb, such as by application of pressure on the door from the exterior side.

The most preferred strike plate is formed from a single sheet of metal with the edge extremity of the lip portion formed by fold of the metal sheet so that the metal sheet forms a return and thereby is of double thickness in the lip portion. The lateral flange extends from a bend of the metal sheet from the return part of the lip portion. The result is an attractive strike plate having the superficial appearance of a conventional strike plate as casually visually observed. The trim strip of the door structure extends over the lateral flange of the strike plate, making it not evident that any such lateral flange is present. This is particularly important to those who wish to improve obstruction to unauthorized entry but do not wish to have their entry door structures take on the appearance of a fortress.

Further obstruction to unauthorized entry is provided by an exterior rigidifying strip of metal on the exterior side of the door adjacent and parallel to the free edge of the door and extending above and below the latch member. This rigidifying strip is equipped with square mounting holes above and below the latch member assembly of the door. It is mounted on the exterior side of the door by bolt members which extend from the exterior side through the door. The bolt members have a smooth head over a square shaft section which is locked non-rotatably in the square mounting holes of the rigidifying strip, thereby making it impossible to remove the bolt members from the exterior by any rotating action or even by any pulling action. The smooth head of the bolt members in combination with the square shaft make them essentially impossible to remove from the exterior side of the door. Nut members are threaded on the end of the bolt members at the interior side of the door. The rigidifying strip as well as the smooth headed bolt members are so oriented on the outside surface of the door adjacent the free edge of it so as to be substantially concealed by the conventional stop strip at the jamb portion of the door frame when the door is closed and viewed from the exterior.

DESCRIPTION OF THE PREFERRED EMBODIMENT

Figure 1:
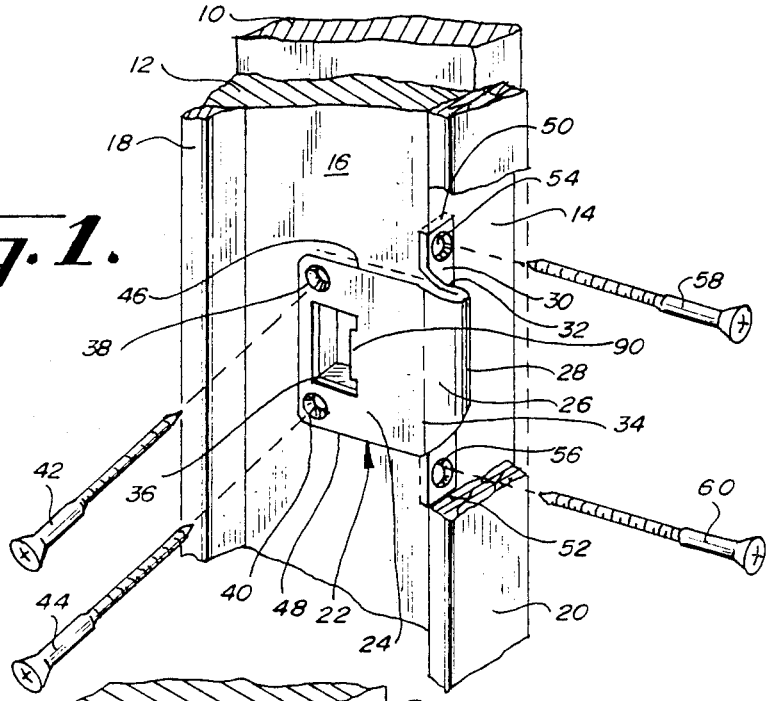
FIG. 1 is a schematic perspective view of the frame part of an entry door structure with parts broken away, and particularly illustrates the mounting of the new strike plate of the invention.

Referring particularly to FIG. 1, elements forming the frame part of the entry door structure will first be discussed, and the discussion will mainly center on the portion of the door frame cooperating with the door as the door is closed by a swinging motion into the frame.

For the most part, frames for dwelling house entry doors are made of wooden parts. After the frame for the opening is roughed in by two-by-fours or a wall stud 10, a finish board called a jamb 12 is fixed in vertical relationship in the opening and usually secured as by nails to the rough wall stud 10, frequently with shins or wedges of wood interposed between the jamb and wall stud so as to effect more or less perfect vertical orientation of the jamb. Placement of the jamb is effective to form a vertical interior edge surface 14 of the jamb, which is the edge surface of the jamb facing the interior of a building. A corresponding exterior edge surface is also formed, but not shown in the drawing. Importantly, the jamb forms a vertical face surface 16 which is substantially parallel and proximate to the free vertical edge of a swinging door when the door is closed. Swinging closure motion of the entry door in the frame is limited by a vertical stop strip 18 fixed as by nails to the jamb toward the exterior side of the entry door structure. Normally a vertical trim strip 20 is placed along the vertical interior edge surface of the jamb and secured by nails. Sometimes the edge of the trim strip most proximate to the face surface of the jamb is spaced slightly back from the face surface 16 of the jamb so as to expose a small strip of the vertical interior edge surface of the jamb adjacent the face surface of the jamb.

The new strike plate 22 of the invention is mounted on the jamb as illustrated in FIG. 1. This strike plate consists of a unitary metal member having a face portion 24, a lip portion 26, with an ending edge extremity 28 for the lip, and a lateral flange 30. The unitary metal member forming the strike plate is shaped such that the face 24 merges into the lip 26 which merges into the lateral flange 30. The lateral flange is oriented perpendicularly to the face 24. In the most preferred structures, the strike plate is formed from a single sheet of metal with the edge extremity 28 of the lip formed by a fold of the metal sheet so that the metal sheet forms a return 32 at the lip portion. This, in effect, causes the lip portion 26 to be of double thickness. Further, the lateral flange 30 is united to the return 32 by a bend of the metal sheet from the return of the lip portion. The lip 26 of the strike plate is curved from the exposed planar surface of the face 24; but the curvature may be relatively sharp and almost angular at the vertical junction 34 between the lip and the face. At the very least, the outer edge extremity 28 of the lip portion is displaced from the plane of the face 24 toward the flange 30. Put another way, the lip outer edge 28 is displaced in a direction toward the frame of the entry door instead of being displaced toward the opening of the entry door. The lip is adapted to be struck by the outwardly biased latch member of a door and cause that latch member to be pressed inwardly of the door as the door is closed in the frame opening.

The face member 24 of the strike plate is equipped with an opening or recess 36 for receiving the latch member of the door after the door is in closed position. Further, the face portion 24 is equipped with vertically spaced beveled mounting holes 38 and 40. Significantly, the spaced mounting holes of the preferred embodiment are toward the edge of the face most remote from the lip 26 of the strike plate. They are not symmetrically oriented above and below the recess 36 for the latch member, as conventionally done. By placing the mounting holes toward the edge of the face most remote from the lip 26, exterior forces of pressure against a door having its latch member lodged in the recess 36 of the face of the strike plate are essentially parallel forces. They are parallel with the thickness of metal forming the face portion 24 of the strike plate and are more or less "dragging" forces of pressure from the mounting holes 38 and 40. Mounting screws 42 and 44 for the face portion extend through the mounting holes 38 and 40 into the jamb (and even through it into stud 10) in fixing the face 24 on the face surface 16 of the jamb.

One further characteristic of the face member 24 of the strike plate is that its upper and lower edges 46 and 48 (which are usually parallel and horizontal) define a vertical dimension which is important in relation to the nature of the lateral flange 30.

The lateral flange has upper and lower ends or edges 50 and 52 (generally horizontal and parallel) which define its vertical dimension. The vertical dimension of the lateral flange 30, however, is greater than the vertical dimension of the face 24 of the strike plate. Further, the lateral flange has beveled mounting holes 54 and 56 exclusively at locations on it higher and lower than the mounting holes 38 and 40 through the face 24 of the strike plate. The lateral flange is securely mounted to the interior edge surface 14 of the jamb beneath the trim strip 20 by screw members 58 and 60 which extend through the mounting holes of the lateral flange 30 into the jamb 12. All screws mounting the face of the strike plate on the jamb extend into the jamb at locations between the jamb penetration of the screws mounting the flange on the jamb. This enhances the resistance of the entire strike plate (i.e., face, lip, and flange) from being forced out of the jamb by application of pressures on the door from the exterior side of it.

Figure 2:
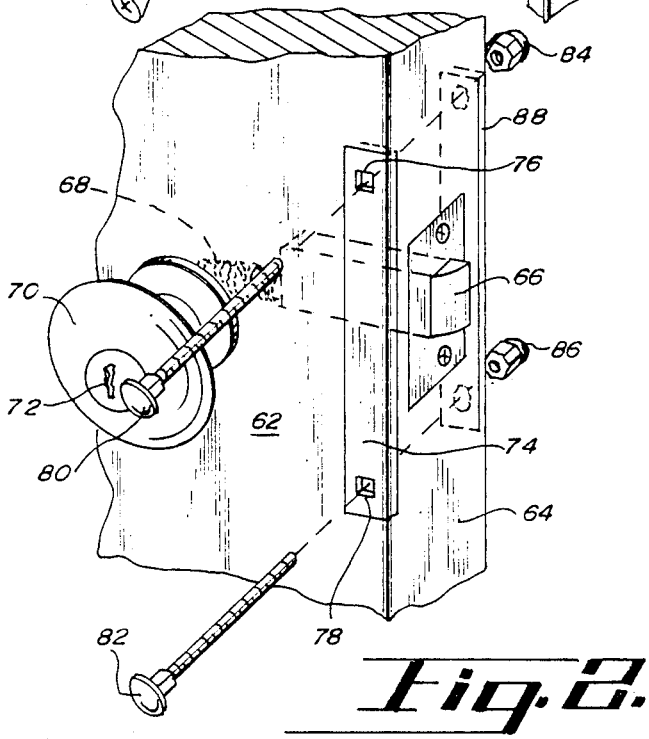
FIG. 2 is a schematic perspective view of the door of an entry door structure (as viewed from the exterior side of the door), with parts broken away, and illustrates the relationship of the exterior rigidifying strip of the invention with respect to the biased latch member assembly of the door.

Referring now to FIG. 2, the door normally is made of wood and is characterized by having an exterior side 62 which faces the exterior of the building and an opposing interior side (not shown) which of course faces the building interior. Further the door has a free vertical edge 64; and characteristically the opposite vertical edge of the door is hinge mounted to permit swinging of it open and closed. A latch member 66 is mounted in the door by any suitable means. The latch member 66 is biased as by a spring 68 to project outwardly from the free vertical edge 64 of the door. Conventional known elements include a door handle 70 and a latch key recess 72 for exterior authorized key withdrawal of the latch member 66 into the door from its illustrated projecting position.

What is uncommon is an exterior rigidifying strip 74 of metal on the exterior side of the door at a location adjacent and parallel to the free edge 64 of the door and extending above and below the mechanism of the latch member 66 of the door. This rigidifying strip 74 on the exterior is equipped with square mounting holes 76 and 78 above and below the level of the latch member assembly 66 of the door. The rigidifying strip is mounted on the exterior side of the door by bolt members 80 and 82 which extend from the exterior side through the door. These bolt members have a smooth head at the end located on the exterior side of the door. Adjacent to the smooth head is a square shaft section which is locked non-rotatably in the square mounting holes of the rigidifying strip. Suitably a comparable rigidifying strip 88 is mounted on the interior side of the door adjacent and parallel to the free edge of the door and extending above and below the latch member assembly of the door. The interior rigidifying strip 88 likewise is provided with mounting holes but these suitably may be circular to accommodate the end portion of the bolts 80 and 82. The bolts are fixed in the door at the interior side of the door by suitable nut members 84 and 86, preferably of a decorative nature since they are exposed to view from the interior. The significant feature of the arrangement is that the exterior rigidifying strip 74 is securely fixed to the door by bolt members 80 and 82 which cannot be rotated and removed from the exterior, and which have smooth heads. Still further, the exterior rigidifying strip 74 and the smooth headed bolt members 80 and 82 securing that strip on the door at its exterior are essentially obscured from exterior view when the door is closed because of the thickness of the stop strip 18 of the frame. The result is that a closed door having the rigidifying strip 74 presents a severe obstacle if anyone were to attempt to press a screwdriver or similar implement around the edge of the door to reach the latch member 66 of the door in attempting forced entry from the exterior. The rigidifying strip does not "give" as wood at that edge would.

Figure 3:
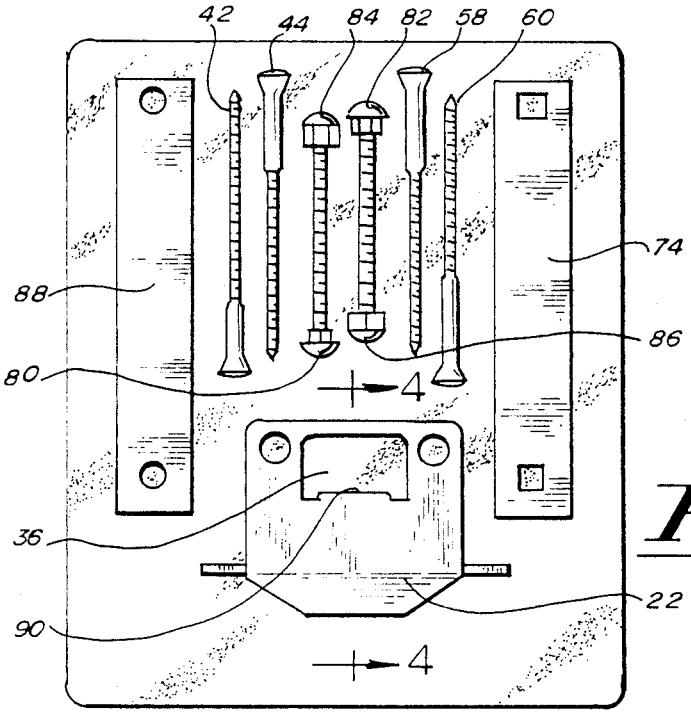
FIG. 3 is a schematic plan view of a kit of the elements of the entry door enhancements of the invention.

A kit of the elements of the invention providing the enhanced structure for an entry door is illustrated in FIG. 3 and consists of the strike plate 22 as particularly discussed with respect to FIG. 1, the face and flange mounting screws 42, 44, 58 and 60 for the strike plate, the exterior rigidifying strip 74 for the door, the interior rigidifying strip 88 for the door and the two bolt members 80 and 82, and the two nut members 84 and 86 for securely fastening the rigidifying strips on the door.

Figure 4:
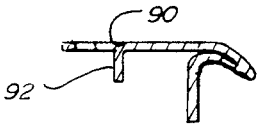
FIG. 4 is a schematic cross sectional view, taken on line 4—4 of FIG. 3, showing the new strike plate with a latch holding part.

FIG. 4 illustrates a feature of the most preferred strike plate not readily apparent from the views of FIGS. 1 and 3, namely that the interior side edge 90 of the strike plate recess 36 for the latch member may be formed by bending a portion of the metal at the recess of the face member so that a latch-contacting flange 92 extends inwardly perpendicularly from the edge 90 of the recess.

Figure 5:
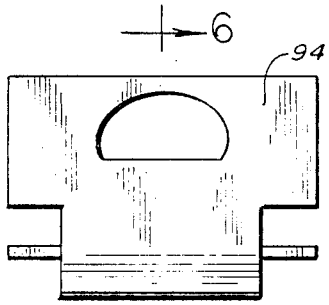
FIG. 5 is a schematic plan view of the new strike plate in modified form.
Figure 6:
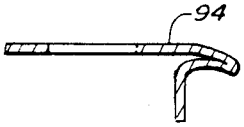
FIG. 6 is a schematic cross sectional view of the strike plate of FIG. 5 taken on line 6—6 of FIG. 5.

The modified strike plate 94 of the invention illustrated in FIGS. 5 and 6 lacks a latch-contacting flange and has a modified shape for the recess especially designed for door latch members having a curved cross section apart from the latching flat surface portion thereof.

It will be appreciated that the invention may be embodied in other specific forms than illustrated without departing from the spirit and essential characteristics thereof. The illustrated embodiment is therefore to be considered to be illustrative and the scope of the invention is set forth in the appended claims. The claims, properly construed, include any equivalence to which they are entitled.

That which is claimed is:

1. In an entry door structure having a exterior side and an interior side, and comprising a frame and a door, said door having an exterior side and an opposing interior side, a free vertical edge, and a latch member biased to project outwardly from the free vertical edge, said frame having a vertical jamb which has a vertical interior edge surface and a vertical face surface, said vertical face being substantially parallel and proximate to the free vertical edge of the door when the door is closed, a vertical stop strip fixed to said jamb toward the exterior side of said door structure for abutment stopping of swinging closure motion of said door in said frame, a vertical trim strip along the vertical interior edge surface of said jamb, and a strike plate on said jamb at a location to be struck by the latch member of said door on swinging closure of said door in said frame, said entry door structure being characterized by the following improvements for enhancing strength of latching of said door, and for thwarting unauthorized forced opening of said door from the exterior side, wherein:

said strike plate consists of a unitary metal member having a face portion which merges into a curved lip portion which merges into a lateral flange oriented perpendicularly to the face portion, said face portion has upper and lower edges defining the vertical dimension thereof and has a recess for receiving said latch member and has spaced mounting holes through which mounting screws extend into said jamb to fix said face portion on the face surface of said jamb, said lateral flange has upper and lower edges defining the vertical dimension thereof, said vertical dimension of said lateral flange being greater than the vertical dimension of said face portion, said lateral flange having mounting holes therethrough exclusively at locations higher and lower than the mounting holes through said face portion, and said lateral flange being securely mounted to the interior edge surface of said jamb beneath said trim strip by screw members which extend through the mounting holes of said flange into said jamb, whereby all screws mounting said face portion of said strike plate on said jamb extend into said jamb at locations between the jamb penetration of the screws mounting said flange on said jamb so as to enhance the resistance of said strike plate from being forced out of said jamb by application of pressures on the door from the exterior side thereof.

2. The entry door structure of claim 1 additionally including an exterior rigidifying strip of metal on the exterior side of the door adjacent and parallel to the free edge of the door and extending above and below the latch member of the door, said rigidifying strip having square mounting holes above and below the latch member of the door and being mounted on the exterior side of the door by bolt members which extend from the exterior side through said door, said bolt members having a smooth head over a square shaft section locked non-rotatably in said square mounting holes, and nut members threaded on the end of said bolt members at the interior side of said door, said rigidifying strip being so oriented on the outside surface of said door adjacent said free edge as to be substantially concealed by said stop strip when said door is closed and viewed from the exterior.

3. The entry door structure of claim 1 wherein said strike plate is further characterized by being formed from a single sheet of metal with the edge extremity of the lip portion formed by a fold of the metal sheet so that the metal sheet forms a return and thereby is of double thickness in said lip portion, and wherein the lateral flange extends from a bend of the metal sheet from the return of the lip portion.

4. A strike plate for an entry door structure, said strike plate consisting of a unitary metal member having a face portion which merges into a curved lip portion which merges into a lateral flange oriented perpendicularly to the face portion, said face portion having upper and lower edges defining the vertical dimension thereof and a recess for receiving an outwardly-biased latch member of a door, and having mounting holes for screw members to fix said face portion on the face surface of a jamb of a frame for an entry door structure, and said lateral flange having upper and lower edges defining the vertical dimension thereof, said vertical dimension of said lateral flange being greater than the vertical dimension of said face portion, said lateral flange having mounting holes extending therethrough exclusively at locations more spaced apart vertically than the mounting holes through said face portion, whereby screw mounting of said strike plate on a jamb of an entry door structure effectively causes the screws mounting said face portion on the jamb to be at locations between the screws mounting said flange on the jamb so as to enhance the resistance of said strike plate from being forced out of the jamb by exterior application of pressure on a door latched in said strike plate.

* * * * *